US010240864B2

(12) United States Patent
Uesaka et al.

(10) Patent No.: US 10,240,864 B2
(45) Date of Patent: Mar. 26, 2019

(54) DRYING DEVICE

(71) Applicant: FUJI XEROX CO., LTD., Tokyo (JP)

(72) Inventors: Tomozumi Uesaka, Kanagawa (JP); Jun Isozaki, Kanagawa (JP); Akira Sakamoto, Kanagawa (JP); Satoshi Hasebe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 316 days.

(21) Appl. No.: 15/210,007

(22) Filed: Jul. 14, 2016

(65) Prior Publication Data

US 2017/0219282 A1 Aug. 3, 2017

(30) Foreign Application Priority Data

Jan. 28, 2016 (JP) ..... 2016-014682

(51) Int. Cl.
*F26B 13/10* (2006.01)
*F26B 3/28* (2006.01)
*B41M 7/00* (2006.01)

(52) U.S. Cl.
CPC ..... *F26B 3/283* (2013.01); *B41M 7/0081* (2013.01); *F26B 13/10* (2013.01)

(58) Field of Classification Search
CPC ..... F26B 3/283; F26B 13/10; B41M 7/0081
USPC ..... 34/60
See application file for complete search history.

(56) References Cited

U.S. PATENT DOCUMENTS 5,090,132 A * 2/1992 Kobayashi ..... F26B 5/06 34/302
5,656,179 A * 8/1997 Gehrmann ..... B01D 33/04 210/771
5,937,535 A * 8/1999 Hoffman, Jr. ..... F26B 13/101 118/65
6,233,841 B1 * 5/2001 Beach ..... A23L 3/54 34/203
6,256,903 B1 * 7/2001 Rudd ..... F26B 13/14 34/202
6,463,674 B1 * 10/2002 Meyers ..... B41J 11/002 34/304

(Continued)

FOREIGN PATENT DOCUMENTS

JP 2015-058392 3/2015
KR 20070107064 A * 11/2007 ..... F26B 13/10
WO WO 2006093654 A1 * 9/2006 ..... F26B 13/10

OTHER PUBLICATIONS

Abstract and machine translation of JP 2015-058392.

*Primary Examiner* — Stephen M Gravini
(74) *Attorney, Agent, or Firm* — Fildes & Outland, P.C.

(57) ABSTRACT

A drying device is provided and includes: plural light emitting units that are disposed with intervals along a transport direction in which a transported body containing liquid is transported and that cause the liquid to be evaporated by irradiating the transported body with light; and a vent mechanism in which a supply unit and a discharge unit are alternately disposed in spaces on an upstream side and a downstream side of the entirety of the plural light emitting units in the transport direction and spaces between the light emitting units along the transport direction. The supply unit supplies air toward the transported body along the irradiating direction of the light, and the discharge unit discharges air in an opposite direction to the irradiating direction from the transported body side.

4 Claims, 11 Drawing Sheets

(56) References Cited

U.S. PATENT DOCUMENTS

| | | | | |
|---|---|---|---|---|
| 7,694,432 | B2 * | 4/2010 | Eriksson | F26B 3/283 110/245 |
| 8,109,010 | B2 * | 2/2012 | Hamamoto | B05D 3/0254 118/58 |
| 8,196,312 | B2 * | 6/2012 | Taguchi | B41C 1/1083 118/65 |
| 8,250,775 | B2 * | 8/2012 | Magaldi | C10B 57/005 122/460 |
| 8,397,400 | B2 * | 3/2013 | Choo | B27K 1/00 110/244 |
| 2005/0212165 | A1 * | 9/2005 | Yamazaki | B29C 39/14 264/146 |
| 2017/0219282 | A1 * | 8/2017 | Uesaka | B41M 7/0081 |

* cited by examiner

DRYING DEVICE

CROSS-REFERENCE TO RELATED APPLICATIONS

This application is based on and claims priority under 35 USC 119 from Japanese Patent Application No. 2016-014682, filed on Jan. 28, 2016.

BACKGROUND

Technical Field

The present invention relates to a drying device.

SUMMARY

An aspect of the invention provides a drying device including:

a plurality of light emitting units that are disposed with intervals along a transport direction in which a transported body containing liquid is transported and that cause the liquid to be evaporated by irradiating the transported body with light; and a vent mechanism in which a supply unit and a discharge unit are alternately disposed in spaces on an upstream side and a downstream side of the entirety of the plurality of light emitting units in the transport direction and spaces between the light emitting units along the transport direction, the supply unit supplying air toward the transported body along the irradiating direction of the light, and the discharge unit discharging air in an opposite direction to the irradiating direction from the transported body side.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described based on the drawings.

Image Forming Apparatus 10

Figure 1:
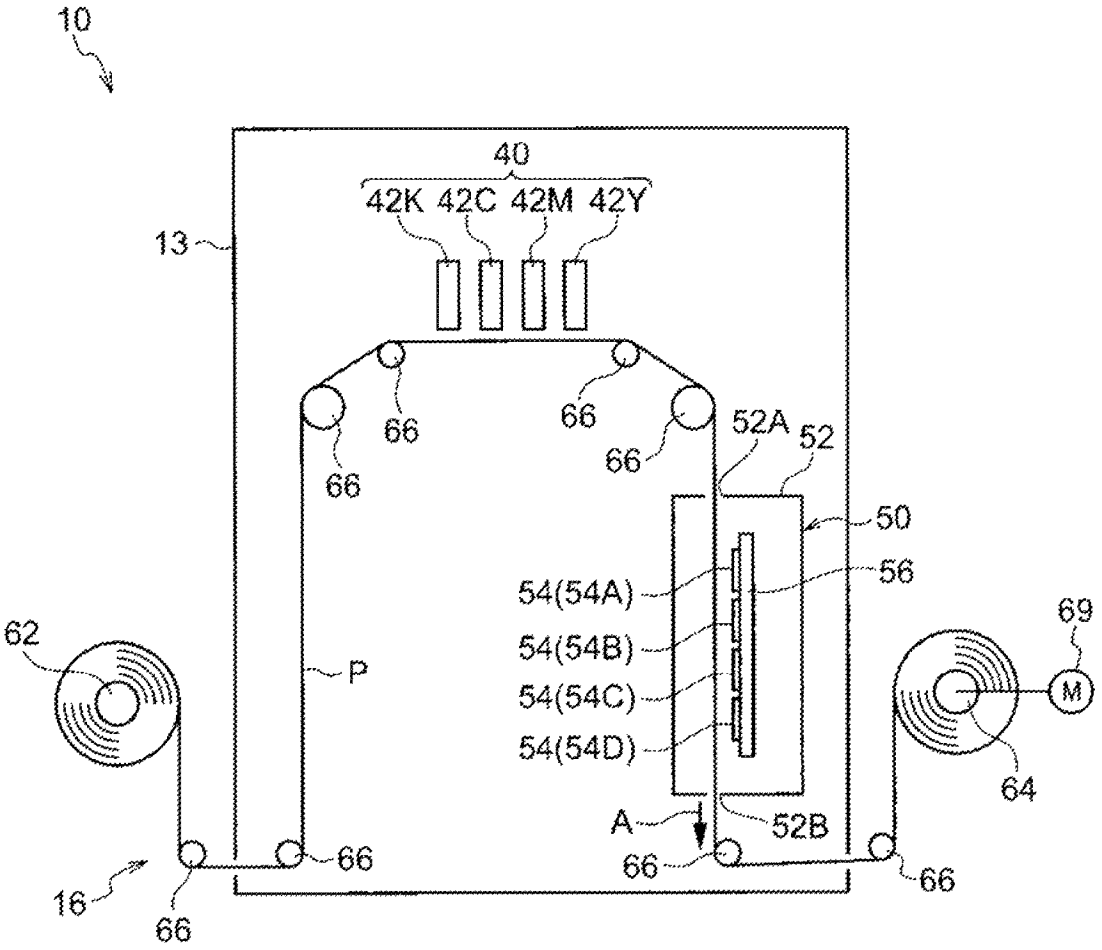
FIG. 1 is a schematic view illustrating a construction of an image forming apparatus according to a present exemplary embodiment.

First, an image forming apparatus 10 (an ejecting device) will be described. FIG. 1 is a schematic view illustrating a construction of the image forming apparatus 10.

As illustrated in FIG. 1, the image forming apparatus 10 includes an image forming apparatus main body 13 (casing), a transport unit 16 that transports continuous paper P (an example of a transported body), an ejecting unit 40 (an ejecting portion) that ejects ink drops (droplets) to the continuous paper P, and a drying device 50 that dries the continuous paper P on which the ink drops are ejected.

The ejecting unit 40 and the drying device 50 are disposed in order from an upstream side of the transport direction of the continuous paper P toward a downstream side thereof. Accordingly, an ejecting operation and a drying operation are performed in order on each portion of the continuous paper P that is transported by the transport unit 16.

Transport Unit 16

The transport unit 16 includes an unwinding roll 62 that unwinds the continuous paper P, a winding roll 64 that winds the continuous paper P, and plural transport rolls 66 that transport the continuous paper P. The winding roll 64 is driven to rotate by a drive unit 69. Accordingly, the winding roll 64 winds the continuous paper P and the unwinding roll 62 unwinds the continuous paper P.

The plural transport rolls 66 are wound on the continuous paper P between the unwinding roll 62 and the winding roll 64. Accordingly, a transport path of the continuous paper P from the unwinding roll 62 to the winding roll 64 is determined. The plural transport rolls 66 rotate along the continuous paper P that proceeds to the winding roll 64 side by the winding roll 64 winding the continuous paper P.

Ejecting Unit 40

The ejecting unit 40 includes ejecting heads 42Y, 42M, 42C, and 42K (hereinafter, referred to as 42Y to 42K) that eject ink drops of respective colors of yellow (Y), magenta (M), cyan (C), and black (K) on the continuous paper P. An image is formed on the continuous paper P, by the ink drops of the respective colors being ejected to the continuous paper P from the ejecting heads 42Y to 42K.

Drying Device 50

Figure 2:
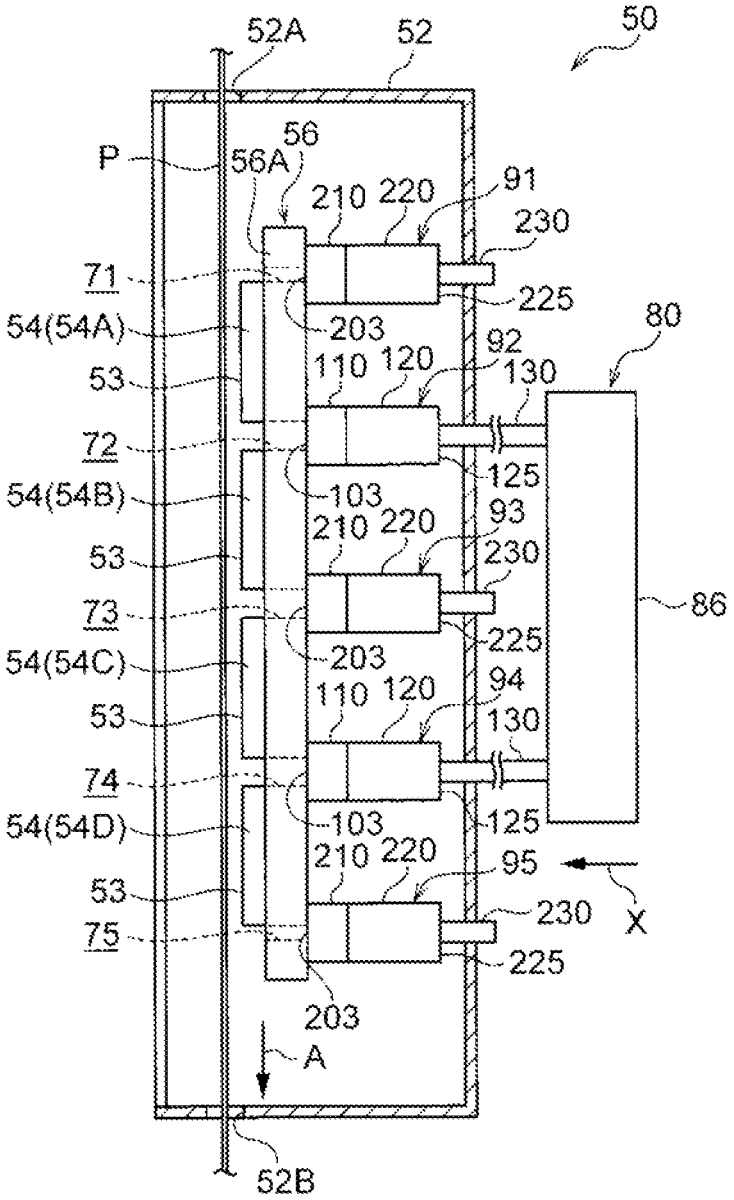
FIG. 2 is a schematic view illustrating a construction of a drying device according to the present exemplary embodiment.

As illustrated in FIG. 2, the drying device 50 includes a casing 52, plural surface-light emitting lasers 54 (an example of the light emitting unit) that are disposed in the inside of the casing 52, a support body 56 that supports the plural surface-light emitting lasers 54, and a vent mechanism 80. An inlet 52A which the continuous paper P enters is formed on the upper portion of the casing 52. An outlet 52B which the continuous paper P exits is formed on the lower portion of the casing 52.

Figure 3:
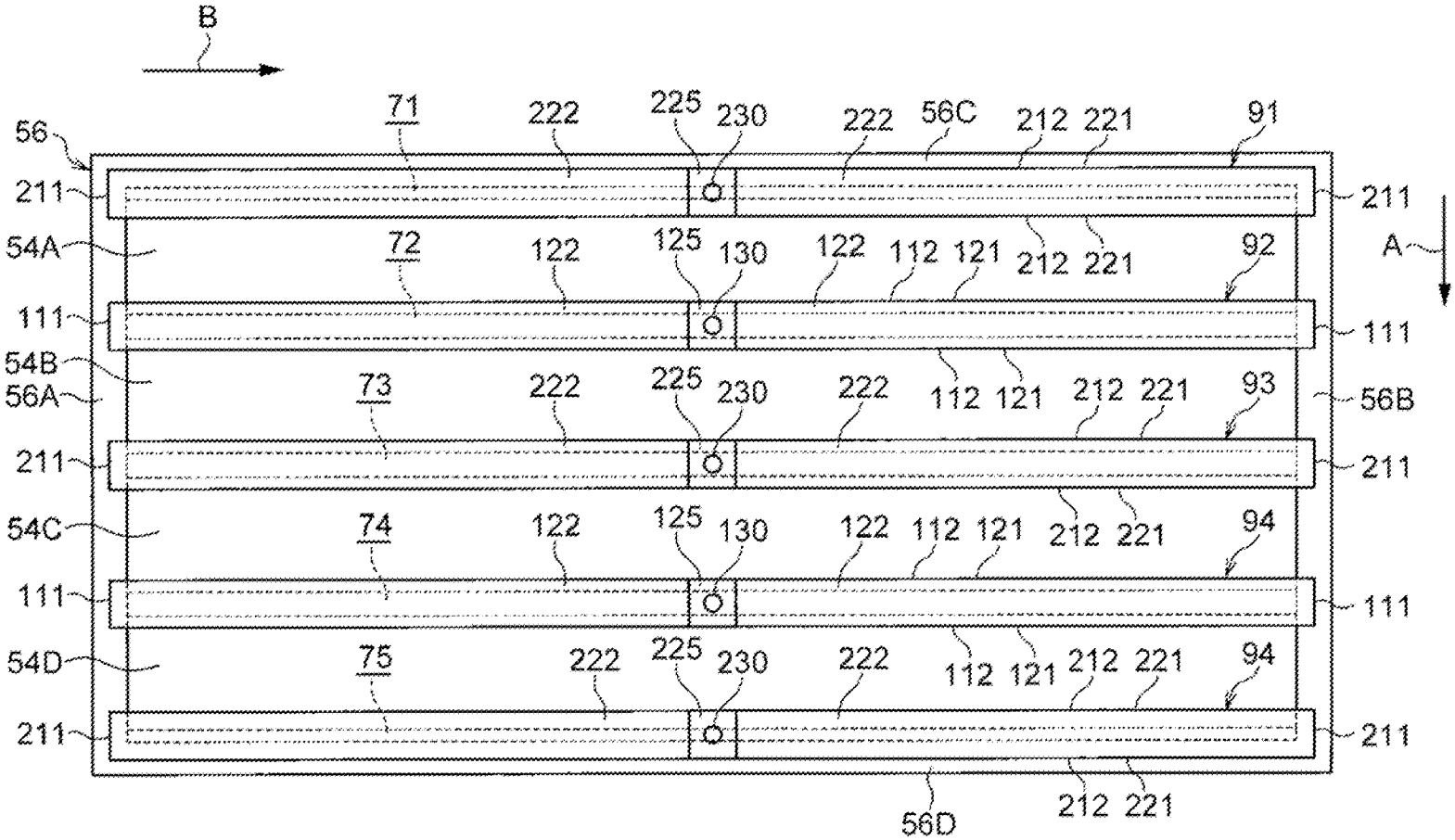
FIG. 3 is a schematic view illustrating a portion of the construction of the drying device according the present exemplary embodiment (a view in the X-arrow direction in FIG. 2)

When viewed from the side surface (when viewed in the X-arrow direction in FIG. 2), as illustrated in FIG. 3, the support body 56 is formed in a frame shape. Specifically, the support body 56 includes a pair of support members 56A and 56B that have lengths along the transport direction (an A direction) of the continuous paper P, and a pair of support members 56C and 56D that have lengths along the width direction (a direction intersecting the transport direction, a B direction) of the continuous paper P.

Figure 4:
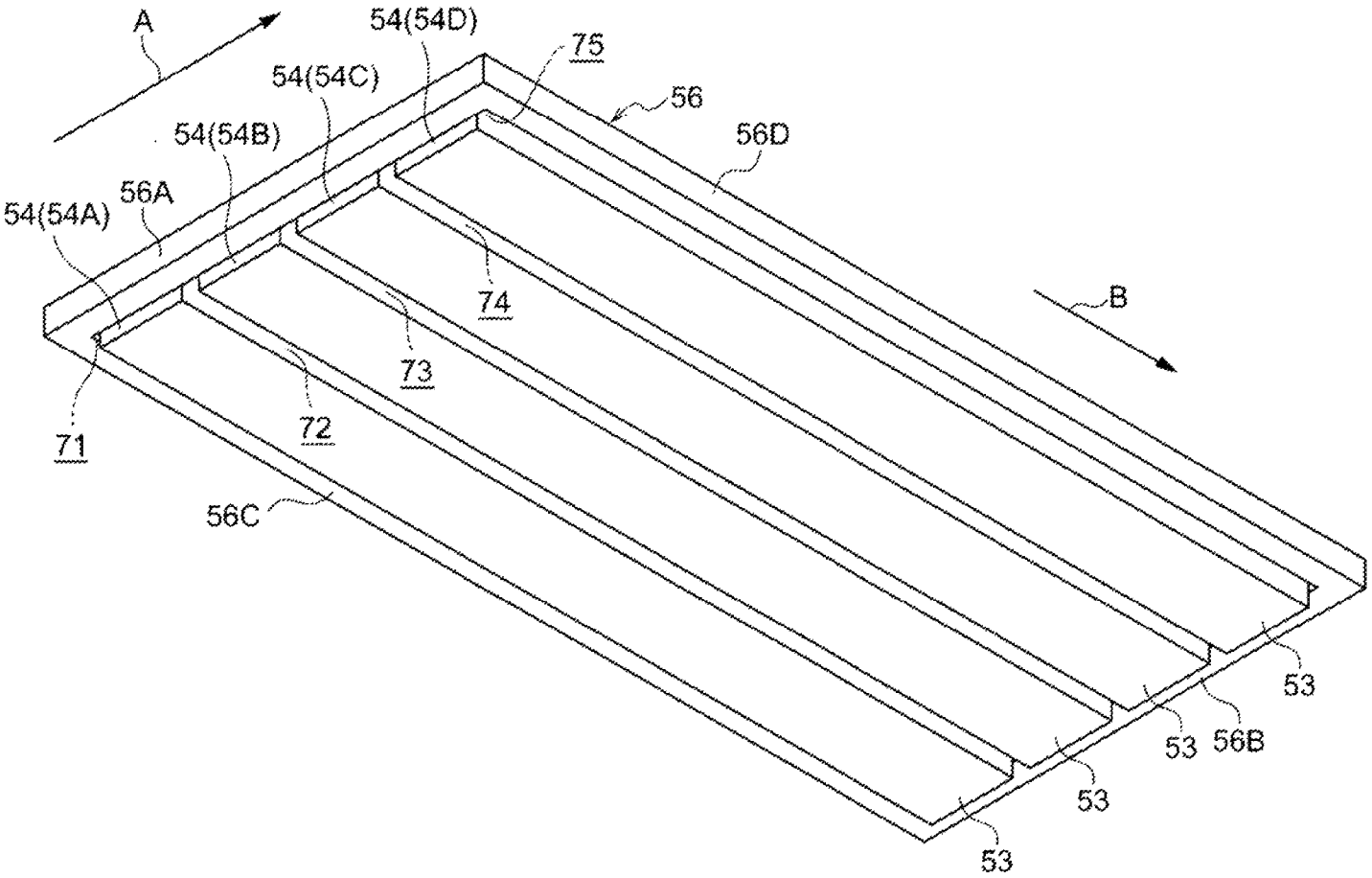
FIG. 4 is a perspective view illustrating a portion of the construction of the drying device according to the present exemplary embodiment.

In the present exemplary embodiment, as illustrated in FIG. 2 and FIG. 4, as the plural surface-light emitting lasers 54, four surface-light emitting lasers 54A, 54B, 54C, and 54D are disposed with intervals along the transport direction of the continuous paper P. Each of the four surface-light emitting lasers 54A, 54B, 54C, and 54D has a length along the width direction (the B direction) of the continuous paper P. Both end portions (both end portions along the transport direction of the continuous paper P) of each of the surface-light emitting lasers 54A, 54B, 54C, and 54D are attached to the pair of support members 56A and 56B.

The surface-light emitting laser 54A disposed on the most upstream side in the transport direction of the continuous paper P has a gap between the surface-light emitting laser 54A and the support member 56C. The surface-light emitting laser 54D disposed on the most downstream side in the transport direction of the continuous paper P has a gap between the surface-light emitting laser 54D and the support member 56D. Accordingly, spaces 71 and 75 are formed on the upstream side and the downstream side of the entirety of the four surface-light emitting lasers 54 in the transport direction of the continuous paper P.

Spaces 72, 73, and 74 are formed between the surface-light emitting laser 54A and the surface-light emitting laser 54B, between the surface-light emitting laser 54B and the surface-light emitting laser 54C, and between the surface-light emitting laser 54C and the surface-light emitting laser 54D, respectively.

The spaces 71, 72, 73, 74, and 75 are disposed in order along the transport direction (the A direction) of the continuous paper P. The spaces 71, 72, 73, 74, and 75 have lengths in the width direction (the B direction) of the continuous paper P.

The four surface-light emitting lasers 54 have irradiating surfaces 53 that radiate a laser (an example of light) and face an image forming surface of the continuous paper P that is transported to the inside of the casing 52. In the drying device 50, moisture of the ink (an example of liquid) on the image forming surface is evaporated and thus the continuous paper P is dried by irradiating the image forming surface of the continuous paper P with a laser from the irradiating surfaces 53 of the four surface-light emitting lasers 54.

As illustrated in FIG. 2, the vent mechanism 80 includes supply ducts 92 and 94 (an example of a supply unit) that supply air, a blower 86, and discharge ducts 91, 93, and 95 (an example of a discharge unit) that discharge air.

The supply ducts 92 and 94 are members that form a supply path supplying air. Specifically, as illustrated in FIG. 5, the supply ducts 92 and 94 include a forming portion 110 that forms a supply port 103, a taper portion 120, and an inflow pipe 130.

Figure 5:
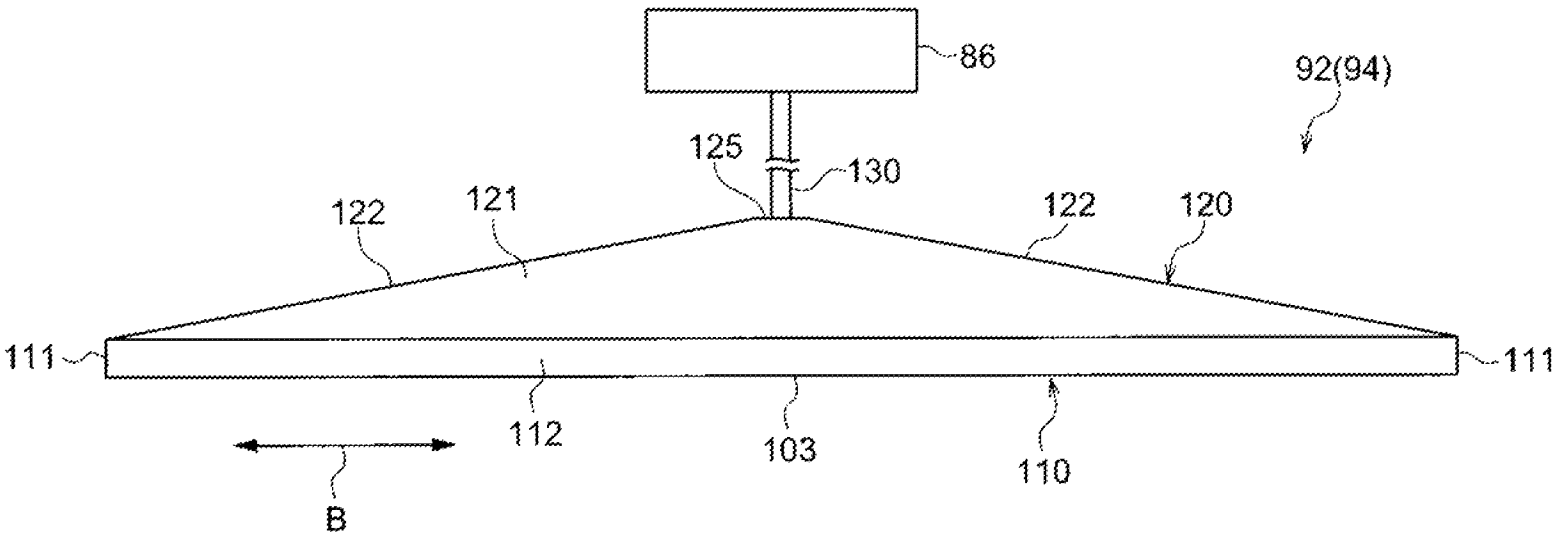
FIG. 5 is a schematic view illustrating a construction of a supply duct according to the present exemplary embodiment.

As illustrated in FIG. 3 and FIG. 5, the forming portion 110 includes a pair of side walls 111 that are opposed to each other in the width direction (the B direction) of the continuous paper P and disposed along the transport direction of the continuous paper P, and a pair of facing walls 112 that are opposed to each other in the transport direction of the continuous paper P and disposed along the width direction (the B direction) of the continuous paper P. The forming portion 110 has an internal space that is surrounded by the pair of side walls 111 and the pair of facing walls 112.

The taper portion 120 includes a pair of trapezoidal walls 121 that have a trapezoidal shape in a plan view (when viewed from the transport direction (the A direction) of the continuous paper P), and a pair of inclined walls 122 that are disposed along a hypotenuse of the pair of trapezoidal walls 121, and a short wall 125 that is disposed along a short side of two sides which are parallel to each other in the pair of trapezoidal walls 121. The taper portion 120 has an internal space that is surrounded by the pair of trapezoidal walls 121, the pair of inclined walls 122, and the short wall 125. The internal space in the taper portion 120 communicates with the internal space of the forming portion 110.

As illustrated in FIG. 2, the inflow pipe 130 passes through the casing 52. One end portion of the inflow pipe 130 is connected to the short wall 125 and communicates with the internal space of the taper portion 120. The other end portion of the inflow pipe 130 communicates with the outside of the casing 52. A blower 86 is connected to the other end portion of the inflow pipe 130.

The blower 86 includes a dehumidifier (not illustrated) that dehumidifies the air sucked from the inside of the image forming apparatus main body 13 and the outside of the casing 52. The blower 86 sucks air of the inside of the image forming apparatus main body 13 and the outside of the casing 52, causes the air to be dehumidified by the dehumidifier, and then causes the air to be fed in the inflow pipe 130. Accordingly, the air in which humidity is lower than that in the air of the inside of the image forming apparatus main body 13 and the air of the inside of the casing 52 is fed in the inflow pipe 130. Further, the dehumidifier includes a dehumidifying filter that absorbs moisture by air passing therethrough or the like, for example. In addition, the humidity of air that is dehumidified by the dehumidifier is equal to or less than 10% RH, for example. Further, the blower 86 may use air in the casing 52 as it is blown without the dehumidifier (a dehumidifying mechanism). However, in a case where there is a large amount of evaporated material such as in a case of high-speed printing, or the like, it is preferable to have the dehumidifier. In addition, an air absorbing unit of the blower 86 may be provided in the outside of the casing 13 and may suck air of the outside of the casing 13. Further, the blower 86 itself may take air of the outside of the casing 13 by being provided in the outside side of the casing 13. In the case of those, the air of the outside of the casing 13 may be used as it is. However, it is preferable to use air dehumidified using the dehumidifier.

The supply ducts 92 and 94 are disposed in the spaces 72 and 74, respectively. In addition, when the supply ducts 92 and 94 are viewed from the side surface thereof (see FIG. 3), the side walls 111 and the facing walls 112 surround the spaces 72 and 74. Accordingly, the supply ports 103 of the supply ducts 92 and 94 are opened to the spaces 72 and 74, respectively.

Accordingly, the air fed to the inflow pipes 130 of the supply ducts 92 and 94 by the blower 86 is discharged from the supply ports 103 through the inside of the taper portion 120 and the forming portion 110 of the supply ducts 92 and 94. The air discharged from the supply ports 103 is supplied to the spaces 72 and 74 toward the continuous paper P along the irradiating direction of the laser. In this way, the supply ducts 92 and 94 supply air along the irradiating direction of the laser toward the continuous paper P in the spaces 72 and 74.

Figure 6:
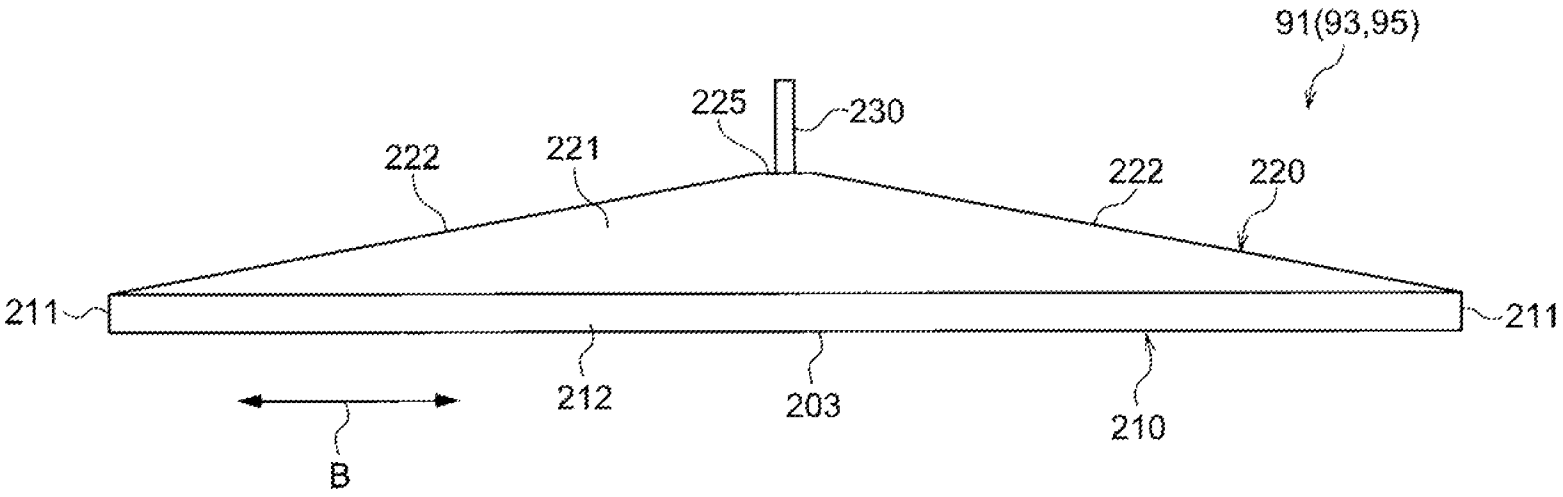
FIG. 6 is a schematic view illustrating a construction of a discharge duct according to the present exemplary embodiment.

On the other hand, the discharge ducts 91, 93, and 95 are members that form a discharge path discharging air, and have the same shapes as the shape of the supply ducts 92 and 94. Specifically, as illustrated in FIG. 6, the discharge ducts 91, 93, and 95 include a forming portion 210 that forms a discharge port 203, a taper portion 220, and an outflow pipe 230. As illustrated in FIG. 3 and FIG. 6, the forming portion 210 includes a pair of side walls 211 that are opposed to each other in the width direction (the B direction) of the continuous paper P and disposed along the transport direction of the continuous paper P, and a pair of facing walls 212 that are opposed to each other in the transport direction of the continuous paper P and disposed along the width direction (the B direction) of the continuous paper P.

The taper portion 220 includes a pair of trapezoidal walls 221 that have trapezoidal shapes in a plan view (when viewed from the transport direction (the A direction) of the continuous paper P), a pair of inclined walls 222 that are disposed along a hypotenuse of the pair of trapezoidal walls 221, and a short wall 225 that is disposed along a short side of two sides which are parallel to each other in the pair of trapezoidal walls 221.

As illustrated in FIG. 2, the outflow pipe 230 passes through the casing 52. One end portion of the outflow pipe 230 is connected to the short wall 225 and communicates with the inside of the taper portion 220. The other end portion of the outflow pipe 230 communicates with the outside of the casing 52. In other words, the discharge ducts 91, 93, and 95 are opened to the outside of the casing 52 by the outflow pipe 230.

The discharge ducts 91, 93 and 95 are disposed in the spaces 71, 73, and 75, respectively. As above, the discharge ducts 91, 93, and 95 and the supply ducts 92 and 94 are alternately disposed in the spaces 71, 72, 73, 74, and 75 (hereinafter, referred to as 71 to 75) along the transport direction of the continuous paper P in the vent mechanism 80.

In addition, when the discharge ducts 91, 93 and 95 are viewed from the side surface thereof (when viewed in X-arrow direction in FIG. 2), the side walls 211 and the facing walls 212 surround the spaces 71, 73, and 75. Accordingly, the discharge ports 203 of the discharge ducts 91, 93 and 95 are opened to the spaces 71, 73, and 75, respectively.

Accordingly, the air supplied toward the continuous paper P along the irradiating direction of the laser in the spaces 72 and 74 flows into the spaces 71, 73, and 75 by air flow generated by the blower 86. Further, the air flowing into the spaces 71, 73, and 75 is discharged to the discharge ducts 91, 93, and 95 from the continuous paper P side toward the opposite direction to the irradiating direction of the laser. Specifically, the air discharged to the discharge ducts 91, 93, and 95 is discharged to the inside of the discharge ducts 91, 93, and 95 through the discharge port 203. Further, the air discharged to the inside of the discharge ducts 91, 93, and 95 flows out to the outside of the casing 52 from the outflow pipe 230.

Further, the air discharged to the outside of the casing 52 is discharged to the outside of the casing 13 by an intake and exhaust mechanism (airflow) equipped in the casing 13. Alternatively, the outflow pipe 230 may be connected to the outside of the casing 13 and may directly discharge the air to the outside of the casing 13. In this case, the blower for discharging may be separately used. In any case, an air flow (path) in which the discharged air is not sucked again directly by the blower 86 is preferable.

Effect According to Present Exemplary Embodiment

In the present exemplary embodiment, moisture (an example of liquid) of the ink on the image forming surface of the continuous paper P is evaporated and thus the continuous paper P is dried by irradiating the image forming surface with a laser from the irradiating surfaces 53 of the four surface-light emitting lasers 54.

Then, the air fed to the inflow pipes 130 of the supply ducts 92 and 94 by the blower 86 is discharged from the supply ports 103 through the inside of the taper portion 120 and the forming portion 110 of the supply ducts 92 and 94. The air discharged from the supply ports 103 is supplied to the spaces 72 and 74 toward the continuous paper P along the irradiating direction of the laser. The air supplied to the space 72 is divided into the surface-light emitting laser 54A side and the surface-light emitting laser 54B side by air flow generated by the blower 86, passes through between the surface-light emitting laser 54A and the continuous paper P and between the surface-light emitting laser 54B and the continuous paper P, and then flows into the spaces 71 and 73.

In addition, the air supplied to the space 74 is divided into the surface-light emitting laser 54C side and the surface-light emitting laser 54D side, passes through between the surface-light emitting laser 54C and the continuous paper P and between the surface-light emitting laser 54D and the continuous paper P, and then flows into the spaces 73 and 75.

Further, the air flowing into the spaces 71, 73, and 75 is discharged from the continuous paper P side to the discharge ducts 91, 93, and 95 toward the opposite direction to the irradiating direction of the laser. Specifically, the air discharged to the discharge ducts 91, 93, and 95 is discharged to the inside of the discharge ducts 91, 93, and 95 through the discharge ports 203. The air discharged to the inside of the discharge ducts 91, 93, and 95 flows out to the outside of the casing 52 from the outflow pipe 230.

Then, the vapor evaporated from the continuous paper P by radiation of the laser is carried by the air passing through between each of the surface-light emitting lasers 54A, 54B, 54C, and 54D and the continuous paper P.

In addition, in the present exemplary embodiment, the discharge ducts 91, 93, and 95 and the supply ducts 92 and 94 are alternately disposed in the spaces 71 to 75 along the transport direction of the continuous paper P. For this reason, air is unlikely to stay and smoothly flows between each of the surface-light emitting lasers 54A, 54B, 54C, and 54D and the continuous paper P, compared to a construction (the first comparative example) in which air is supplied along the irradiating direction of the laser in all of the spaces 71 to 75.

Accordingly, according to the present exemplary embodiment, the vapor evaporated from the continuous paper P is restrained from being attached to the irradiating surface 53 of the surface-light emitting lasers 54A, 54B, 54C, and 54D, compared to the first comparative example. Accordingly, the vapor attached to the irradiating surface 53 is condensed and becomes water drops and a phenomenon that hinders the laser from being radiated to the continuous paper P by the water drops is restrained.

In addition, in the present exemplary embodiment, the air in which humidity is lower than that in the air of the inside of the image forming apparatus main body 13 and the air of the inside of the casing 52 is supplied. For this reason, the vapor evaporated from the continuous paper P is sucked in the air and thus the vapor is likely to be discharged, compared to a configuration (the second comparative example) that supplies air having the same humidity as the humidity of air of the inside of the image forming apparatus main body 13 and air of the inside of the casing 52. Accordingly, the vapor evaporated from the continuous paper P is restrained from being attached to the irradiating surface 53 of the surface-light emitting lasers 54A, 54B, 54C, and 54D, compared to the second comparative example.

First Modified Example

Figure 7:
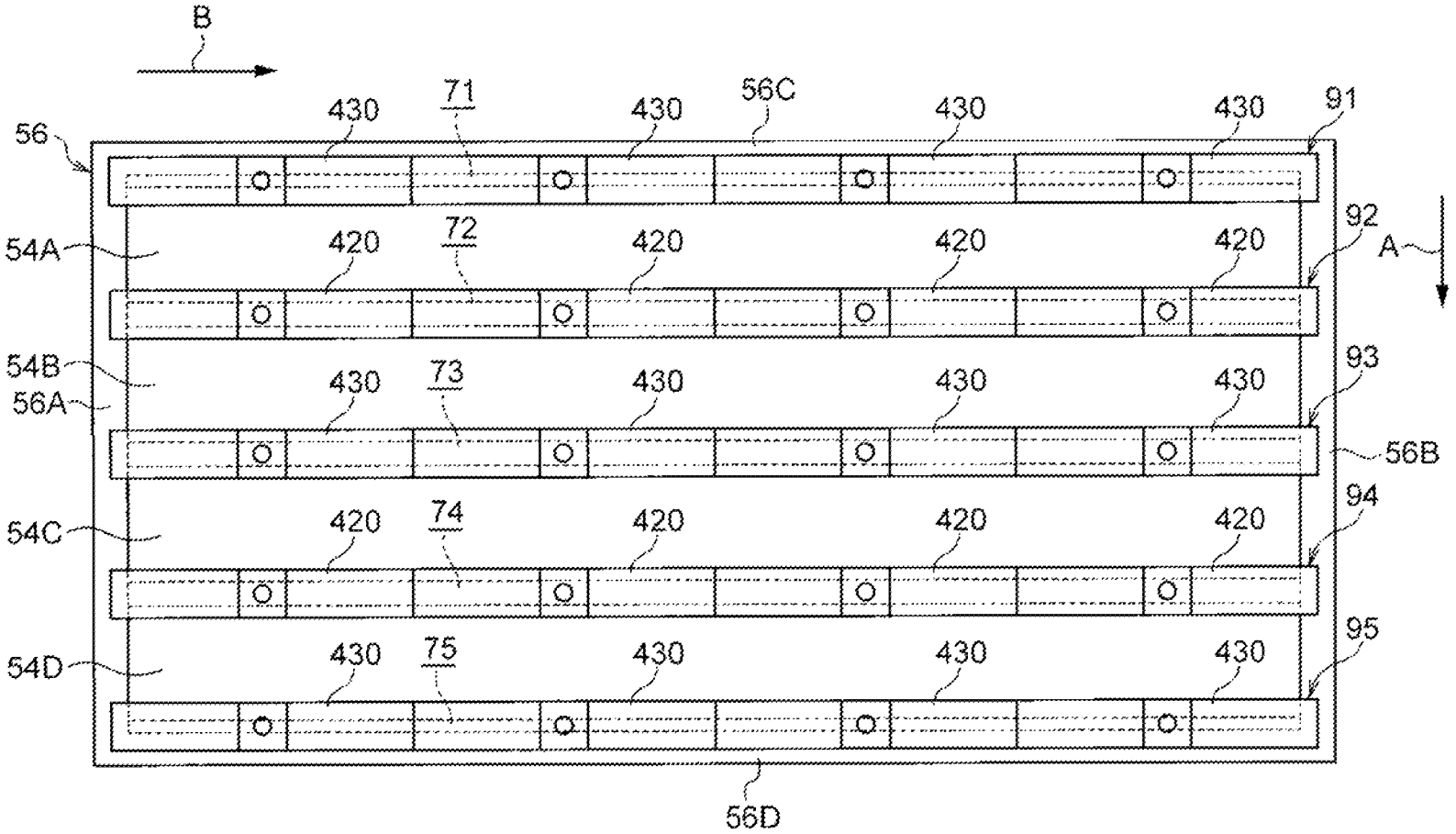
FIG. 7 is a schematic view illustrating a construction of a drying device according to a first modified example.
Figure 8:
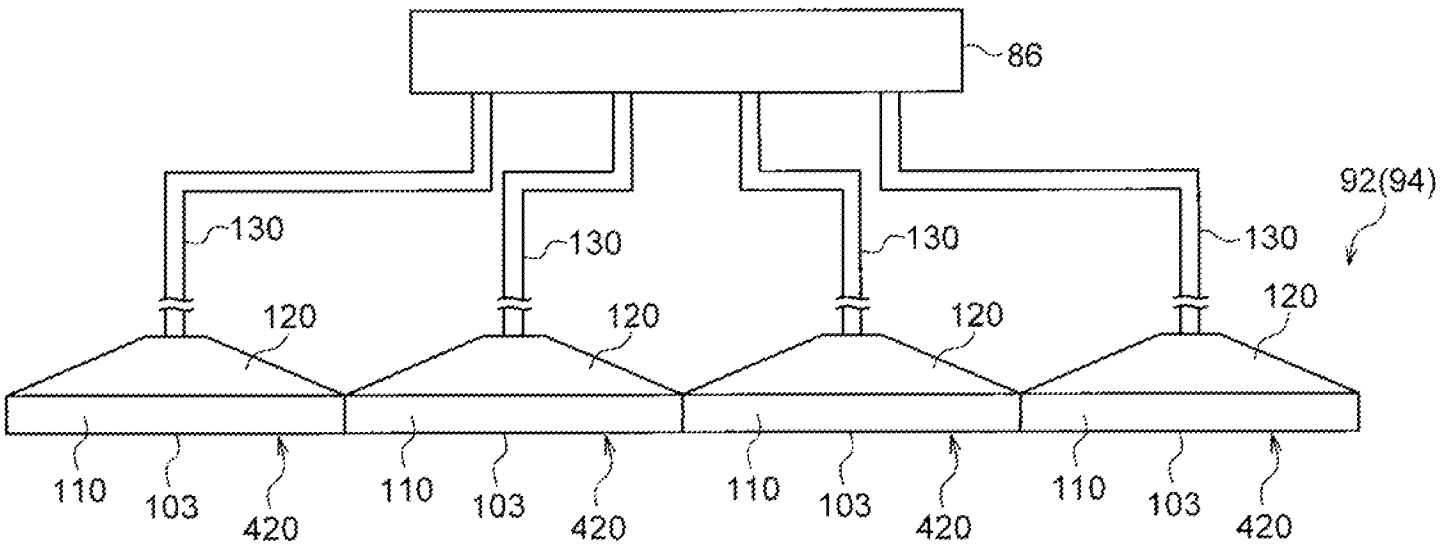
FIG. 8 is a schematic view illustrating a construction of a supply duct according to the first modified example.

As illustrated in FIG. 7 and FIG. 8, the supply ducts 92 and 94 may include plural supply ducts 420, respectively. In the example illustrated in FIG. 7 and FIG. 8, the supply ducts 92 and 94 include four supply ducts 420, respectively.

The supply ducts 92 and 94 have four supply ducts 420 which are disposed along the longitudinal direction (the width direction of the continuous paper P, the B direction) of the spaces 72, and 74. Each of the supply ducts 420 has the same configuration as the supply ducts 92 and 94 described above and illustrated in FIG. 5, except that the length along the width direction of the continuous paper P is short. Further, in each portion of each of the supply ducts 420, the same reference numerals are given to portions having the same functions as each part of the supply ducts 92 and 94.

Then, in the present modified example, the inflow pipes 130 of the each of the supply ducts 420 in the supply ducts 92 and 94 are connected to the blower 86.

Figure 9:
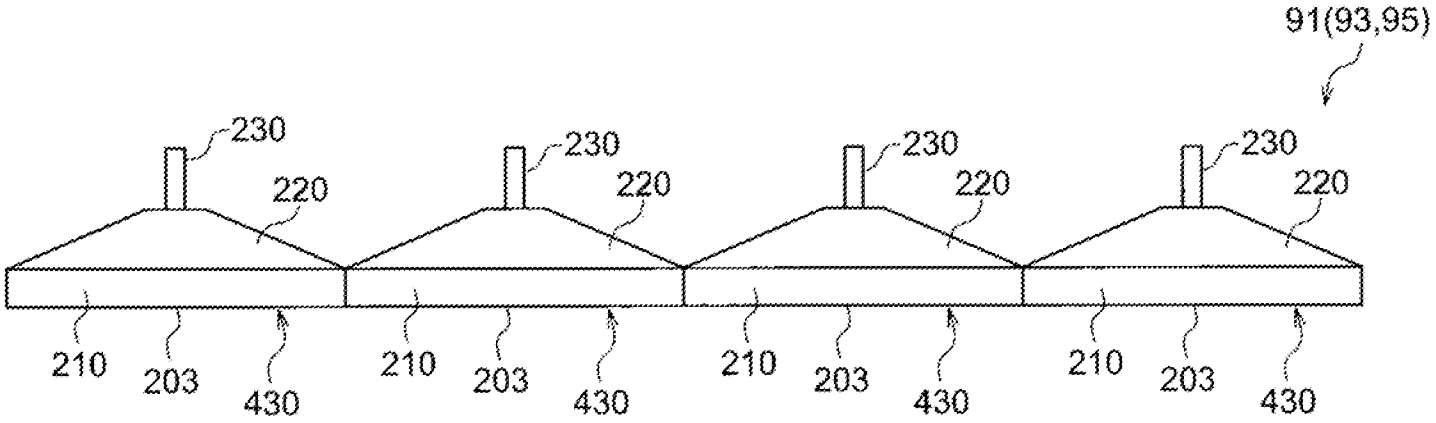
FIG. 9 is a schematic view illustrating a construction of a discharge duct according to the first modified example.

As illustrated in FIG. 7 and FIG. 9, the discharge ducts 91, 93, and 95 may include plural discharge ducts 430, respectively. In the example illustrated in FIG. 7 and FIG. 9, the discharge ducts 91, 93, and 95 include four discharge ducts 430, respectively.

Each of the discharge ducts 91, 93 and 95 have four discharge ducts 430 which are disposed along the longitudinal direction (the width direction of the continuous paper P, the B direction) of the spaces 71, 73, and 75. Each of the discharge ducts 430 has the same configuration as the discharge ducts 91, 93 and 95 described above and illustrated in FIG. 6, except that the length along the width direction of the continuous paper P is short. Further, in the each portion of each of discharge ducts 430, the same reference numerals are given to portions having the same functions as each part of the discharge ducts 91, 93 and 95.

In a configuration of the present modified example, the air fed to the inflow pipe 130 of each of the supply ducts 420 of the supply ducts 92 and 94 by the blower 86 is discharged from the supply ports 103 through the inside of the taper portion 120 and the forming portion 110 of each of the supply ducts 420. The air discharged from the supply port 103 is supplied to the spaces 72 and 74 toward the continuous paper P along the irradiating direction of the laser. The air supplied to the space 72 is divided into the surface-light emitting laser 54A side and the surface-light emitting laser 54B side by air flow generated by the blower 86, passes through between the surface-light emitting laser 54A and the continuous paper P and between the surface-light emitting laser 54B and the continuous paper P, and then flows into the spaces 71 and 73.

In addition, the air supplied to the space 74 is divided into the surface-light emitting laser 54C side and the surface-light emitting laser 54D side, passes through between the surface-light emitting laser 54C and the continuous paper P and between the surface-light emitting laser 54D and the continuous paper P, and then flows into the spaces 73 and 75.

Further, the air flowing into the spaces 71, 73, and 75 is discharged from the continuous paper P side to each of the discharge ducts 430 of the discharge ducts 91, 93, and 95 toward the opposite direction to the irradiating direction of the laser. Specifically, the air discharged to each of the discharge ducts 430 is discharged to the inside of each of the discharge ducts 430 through the discharge ports 203. The air discharged to the inside of each of the discharge ducts 430 flows out to the outside of the casing 52 from the outflow pipe 230.

Then, the vapor evaporated from the continuous paper P by radiation of the laser is carried by the air passing through between each of the surface-light emitting lasers 54A, 54B, 54C, and 54D and the continuous paper P. Accordingly, the vapor evaporated from the continuous paper P is restrained from being attached to the irradiating surfaces 53 of the surface-light emitting lasers 54A, 54B, 54C, and 54D. Accordingly, the vapor attached to the irradiating surface 53 is condensed and becomes water drops and a phenomenon that hinders the laser from being radiated to the continuous paper P by the water drops is restrained.

In addition, in the construction of the present modified example, since the air is supplied from the plural supply ducts 420 disposed along the longitudinal direction of the spaces 72 and 74 to the spaces 72 and 74, a volume of the air supplied is restrained from being non-uniform in the longitudinal direction of the spaces 72 and 74, compared to a construction (a comparative example) in which the air is supplied from a single duct to the spaces 72 and 74.

In the construction of the present modified example, since the air is discharged from the spaces 71, 73, and 75 to the plural discharge ducts 430 disposed along the longitudinal direction of the spaces 71, 73 and 75, a volume of the air discharged is restrained from being non-uniform in the longitudinal direction of the spaces 71, 73 and 75, compared to a construction (a comparative example) in which the air is discharged to a single duct.

Second Modified Example

Figure 10:
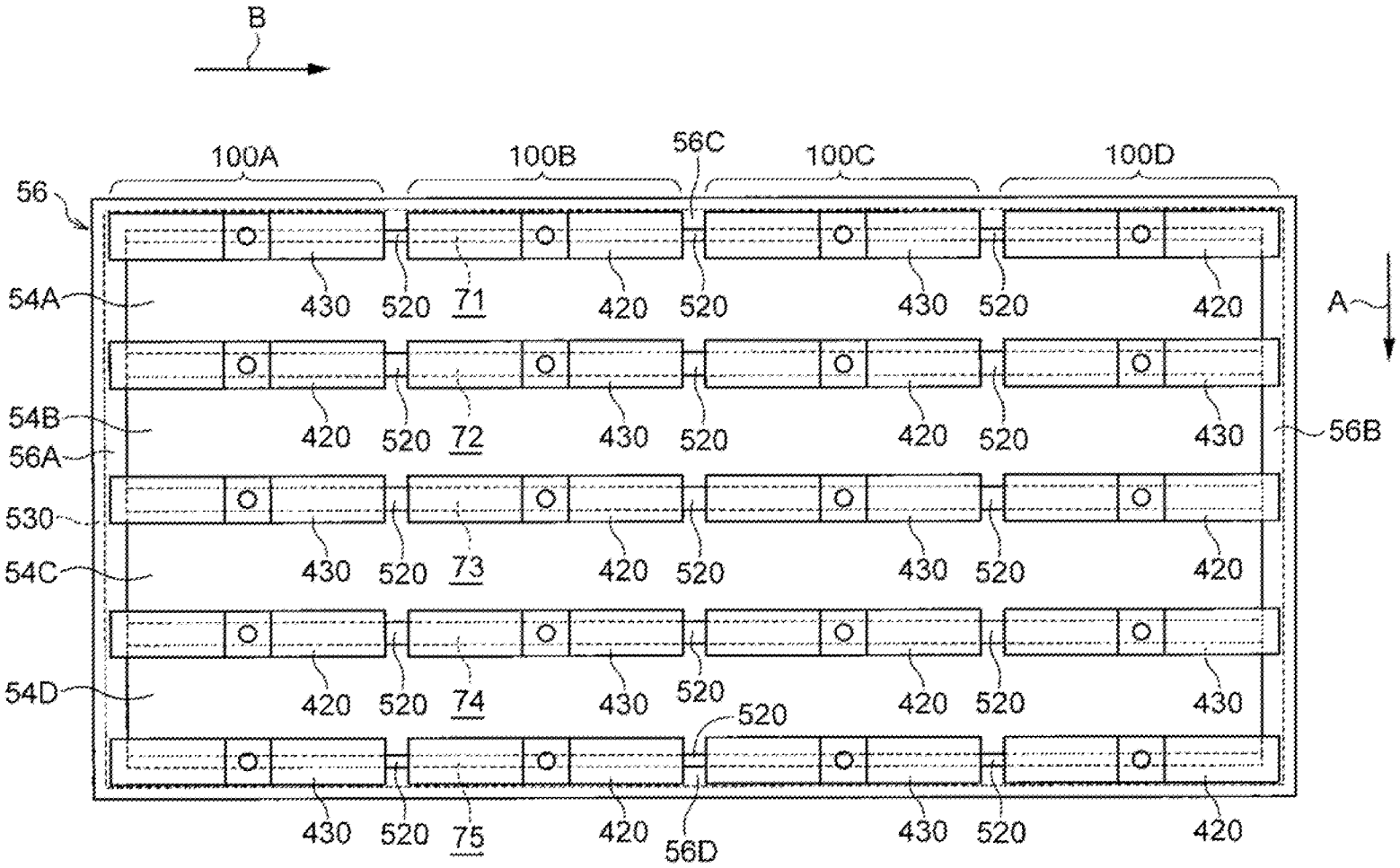
FIG. 10 is a schematic view illustrating a construction of a drying device according a second modified example (a view in the X-arrow direction in FIG. 11)

In a second modified example, as illustrated in FIG. 10, a discharge duct 430, a supply duct 420, a discharge duct 430, and a supply duct 420 are disposed in order from one end side of the spaces 71, 73, and 75 in the longitudinal direction to the other end thereof (to the B direction) in the spaces 71, 73, and 75.

In addition, an supply duct 420, a discharge duct 430, an supply duct 420, and a discharge duct 430 are disposed in order from one end side of the spaces 72 and 74 in the longitudinal direction to the other end thereof (to B direction) in the spaces 72 and 74.

Then, in each portion of the spaces 71 to 75 in the longitudinal direction (portions indicated with 100A, 100B, 100C, and 100D in FIG. 10), the discharge ducts 430 and the supply ducts 420 are alternately disposed along the transport direction of the continuous paper P in the spaces 71 to 75.

Figure 11:
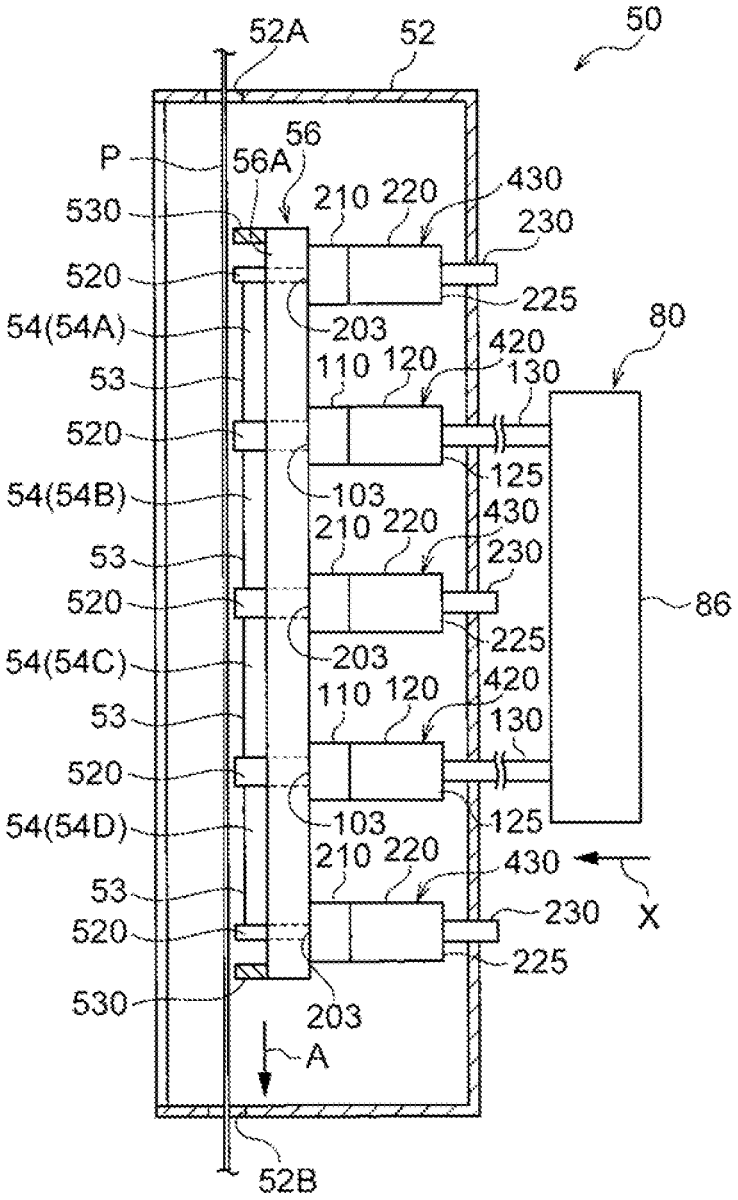
FIG. 11 is a schematic view illustrating a construction of the drying device according to the second modified example.

In each of the spaces 71 to 75, as illustrated in FIG. 10 and FIG. 11, partition plates 520 are provided between the discharge ducts 430 and the supply ducts 420. By this partition plate 520, in each of the spaces 71 to 75, ventilation is restrained between the discharge duct 430 and the supply duct 420.

Further, in the lower surface of support members 56A, 56B, 56C, and 56D of a support body 56, a partition frame 530 is formed in the same frame shape as the support body 56. By this partition frame 530, ventilation is restrained between the outside of the support body 56 and the partition frame 530.

In a configuration of the present modified example, the air fed to the inflow pipe 130 of each of the supply ducts 420 by the blower 86 is discharged from the supply port 103 through the inside of the taper portion 120 and the forming portion 110 of each of the supply ducts 420.

In the portion 100A (one end portion) and the portion 100C of the longitudinal direction of the spaces 71 to 75, the air discharged from the supply port 103 is supplied to the spaces 72 and 74 toward the continuous paper P along the irradiating direction of the laser. The air supplied to the space 72 is divided into the surface-light emitting laser 54A side and the surface-light emitting laser 54B side by air flow generated by the blower 86, passes through between the surface-light emitting laser 54A and the continuous paper P and between the surface-light emitting laser 54B and the continuous paper P, and then flows into the spaces 71 and 73.

In addition, the air supplied to the space 74 is divided into the surface-light emitting laser 54C side and the surface-light emitting laser 54D side, passes through between the surface-light emitting laser 54C and the continuous paper P and between the surface-light emitting laser 54D and the continuous paper P, and then flows into the spaces 73 and 75.

Further, the air flowing into the spaces 71, 73, and 75 is discharged from the continuous paper P side to each of the discharge ducts 430 toward the opposite direction to the irradiating direction of the laser. Specifically, the air discharged to each of the discharge ducts 430 is discharged to the inside of each of the discharge ducts 430 through the discharge ports 203. The air discharged to the inside of each of the discharge ducts 430 flows out to the outside of the casing 52 from the outflow pipes 230.

In the portion 100B and the portion 100D (the other end portion) of the longitudinal direction of the spaces 71 to 75, the air discharged from the supply ports 103 is supplied to the spaces 71, 73 and 75 toward the continuous paper P along the irradiating direction of the laser.

The air supplied to the space 71 passes through between the surface-light emitting laser 54A and the continuous paper P and then flows into the spaces 72, by air flow generated by the blower 86.

In addition, the air supplied to the space 73 is divided into the surface-light emitting laser 54B side and the surface-light emitting laser 54C side by air flow generated by the blower 86, passes through between the surface-light emitting laser 54B and the continuous paper P and between the surface-light emitting laser 54C and the continuous paper P, and then flows into the spaces 72 and 74.

Further, the air supplied to the space 75 passes through between the surface-light emitting laser 54D and the continuous paper P and then flows into the spaces 74, by air flow generated by the blower 86.

Then, the air flowing into the spaces 72 and 74 is discharged from the continuous paper P side to each of the discharge ducts 430 toward the opposite direction to the irradiating direction of the laser. Specifically, the air discharged to each of the discharge ducts 430 is discharged to the inside of each of the discharge ducts 430 through the discharge ports 203. The air discharged to the inside of each of the discharge ducts 430 flows out to the outside of the casing 52 from the outflow pipe 230.

In this way, the vapor evaporated from the continuous paper P by radiation of the laser is carried by the air passing through between each of the surface-light emitting lasers 54A, 54B, 54C, and 54D and the continuous paper P. Accordingly, the vapor evaporated from the continuous paper P is restrained from being attached to the irradiating surface 53 of the surface-light emitting lasers 54A, 54B, 54C, and 54D. Accordingly, the vapor attached to the irradiating surface 53 is condensed and becomes water drops and a phenomenon that hinders the laser from being radiated to the continuous paper P by the water drops is restrained.

Other Modified Example

In the vent mechanism 80, the air from the outflow pipes 230 of the discharge ducts 91, 93, and 95 is discharged by air flow generated by the blower 86. However, the configuration of the vent mechanism is not limited to this configuration. For example, a suction device may be provided to the other end portion of the outflow pipe 230 and thus air may be actively discharged from the outflow pipe 230 by the suction device.

In the vent mechanism 80, by the blower 86, the air is fed from the supply ducts 92 and 94 side (an active side) and the air is naturally discharged from the discharge ducts 91, 93, and 95 side (a passive side). However, this configuration may be reversed. In other words, even if the vent mechanism is configured such that the air is forcedly sucked from the discharge ducts 91, 93, and 95 side (an active side) and the air is naturally sucked from the supply ducts 92 and 94 side (a passive side), since substantial air flow of the two configurations described above is substantially the same, the same effect is obtained. In this case, in FIG. 2, an active blower 86 is not provided and instead an active suction device is connected to the outflow pipe 230. In this case, the air sucked from the inflow pipe 130 may be the air of the inside of the casing 13 and of the outside of the casing 52 and may be sucked from the outside of the casing 13 piped to the outside of the casing 13. In addition, the air sucked from the outflow pipe 230 by the suction device may be discharged to the inside of the casing 13 and of the outside of the casing 52 and may be discharged to the outside of the casing 13 piped to the outside of the casing 13. The suction device may be provided to any one of the inside of the casing 52, the inside of the casing 13, and the outside of the casing 13.

In addition, in the present exemplary embodiment, the liquid contained in the continuous paper P is ink. However, the liquid is not limited to ink and the liquid may be other liquid.

In addition, in the present exemplary embodiment, the continuous paper P is used as a transported body. However, the transported body is not limited to the continuous paper P. The transported body, for example, may be a recording medium of a card paper or the like of which a length in the transport direction has a predetermined length or a recording medium in which liquid is contained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drying device comprising:

a plurality of light emitting units that are disposed with intervals along a transport direction in which a transported body containing liquid is transported and that cause the liquid to be evaporated by irradiating the transported body with light in an irradiating direction; and a vent mechanism including a supply unit and a discharge unit, the supply unit including a plurality of supply ducts for supplying air toward the transported body along the irradiating direction, the discharge unit including a plurality of discharge ducts for discharging air in an opposite direction to the irradiating direction from a side of the transported body, the supply ducts and the discharge ducts being alternately disposed in spaces in the vent mechanism, the spaces including (i) a space formed upstream relative to a light emitting unit disposed on most upstream side of the plurality of light emitting units in the transport direction, (ii) spaces formed between the light emitting units, and (iii) a space formed downstream relative to a light emitting unit disposed on a most downstream side of the plurality of light emitting units in the transport direction.

2. The drying device according to claim 1, wherein the supply unit supplies air having a humidity lower than a humidity in an inside of the drying device.

3. The drying device according to claim 1, wherein the spaces have lengths in a longitudinal direction intersecting the transport direction and the irradiating direction, and wherein a plurality of supply units are disposed along the longitudinal direction of the spaces.

4. The drying device according to claim 1, wherein the spaces have lengths in a longitudinal direction intersecting the transport direction and the irradiating direction, and wherein a plurality of discharge units are disposed along the longitudinal direction of the spaces.

* * * * *